United States Patent [19]

Bert

[11] Patent Number: 4,827,628

[45] Date of Patent: May 9, 1989

[54] COOLING APPARATUS

[76] Inventor: Raymond E. Bert, P.O. Box 16, Sedgwick, Kans. 67135

[21] Appl. No.: 155,313

[22] Filed: Feb. 12, 1988

[51] Int. Cl.[4] ..... F26B 19/00

[52] U.S. Cl. ..... 34/65; 34/236

[58] Field of Search ..... 34/20, 65, 66, 236, 34/64, 66

[56] References Cited

U.S. PATENT DOCUMENTS 3,955,288 5/1976 Keirn ..... 34/65

*Primary Examiner*—Henry A. Bennet

*Attorney, Agent, or Firm*—Dean P. Edmundson

[57] ABSTRACT

Apparatus and techniques are described for using air to remove moisture from particulate material such as hay (e.g., alfalfa, clover, grass, etc.), other roughage feedstuffs, straw, and even finely ground feedstuffs. The apparatus includes a housing with an air inlet in the bottom portion and an air outlet in the top portion. The particulate material is conveyed out of the housing at the bottom. A fan draws air through the housing from the bottom portion to the top in a manner such that the air passes through and around the particulate material to absorb moisture. This also cools the particulate material.

6 Claims, 2 Drawing Sheets

COOLING APPARATUS

FIELD OF THE INVENTION

This invention relates to cooling apparatus. More particularly, this invention relates to cooler/evaporator devices. In another aspect this invention relates to cooling and drying of particulate materials such as feedstuffs, for example.

BACKGROUND OF THE INVENTION

Conventionally, feedstuffs such as hay (e.g., alfalfa, clover, grasses, etc.) are cut, dried naturally in the field, and then baled into bales of various sizes. This procedure is extremely dependent upon the weather. If there is rain or high humidity after the hay is cut, several days may be required before the hay is dried sufficiently to permit baling. If too much moisture is present in the hay when it is baled it can spoil easily.

Recently there has been proposed a procedure for drying chopped hay in a heated dryer and then packaging the hay in containers for shipment and storage until the hay is fed to animals. However, it is not desirable to package chopped hay until it has been cooled to ambient temperature and dried sufficiently to reduce moisture content.

There has not heretofore been described an effective and efficient technique for cooling and drying particulate material such as chopped hay or other particulate feedstuffs. The present invention provides apparatus which is very useful in such situations.

SUMMARY OF THE PRESENT INVENTION

In accordance with the present invention there is provided cooler apparatus which is especially effective in drying and cooling particulate materials such as feedstuffs (e.g., alfalfa, clover, grasses, etc.), roughage materials, etc. In a preferred embodiment the apparatus of the invention comprises:

(a) a housing having top and bottom portions, the housing including an opening in the top for introducing particulate material into the housing, and the housing further including at least one air inlet in the bottom portion and an air outlet in the top portion;

(b) air movement means for drawing air into the housing through the air inlet and then out of the housing through the outlet in a manner such that the air is able to absorb moisture from the particulate material;

(c) conveyor means in the bottom portion of the housing, the conveyor means being adapted to convey the particulate material out of the housing.

The particulate material is cooled in the housing when the air absorbs moisture from the particulate material. The particulate material is easily cooled to ambient temperature or even below using the apparatus of this invention.

The cooling unit may be used to dry and cool particulate material of various particle sizes. For example, the particles may be finely ground or they may be fibers having a length of several inches.

The apparatus is especially useful for cooling particles of feedstuffs such as chopped hay which have been partially dried in a conventional heated dryer. Such particles are warmer than ambient temperature and also contain more moisture than permissible for safe packaging (especially in airtight containers). Using the apparatus of this invention such particulate materials can be reduced in moisture content and also in temperature in order to render them suitable for shipping and storage without danger of spoilage.

The amount of air flow through the cooling apparatus may be varied, as desired, in order to control the rate at which moisture is absorbed from the particulate material and the rate at which the material is cooled.

Other advantages of the apparatus of this invention will be apparent from the following detailed description and the accompanying drawings.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

Figure 1:
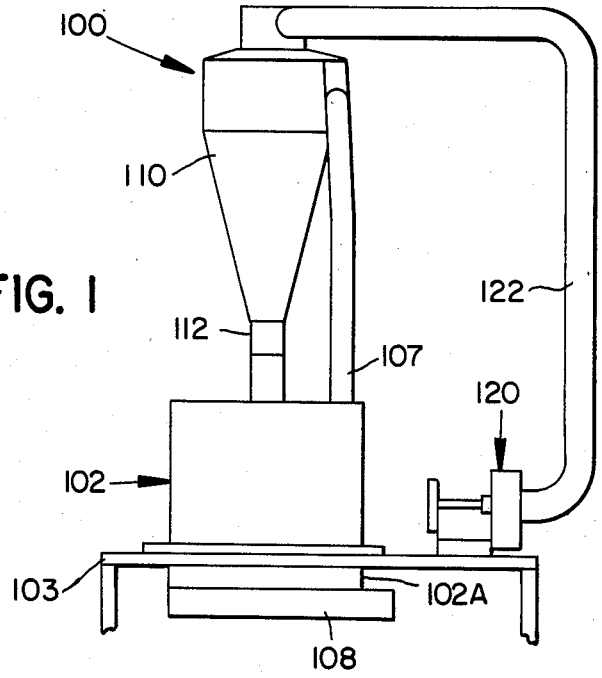
FIG. 1 is a side elevational view of a preferred embodiment of cooling apparatus of the invention.
Figure 2:
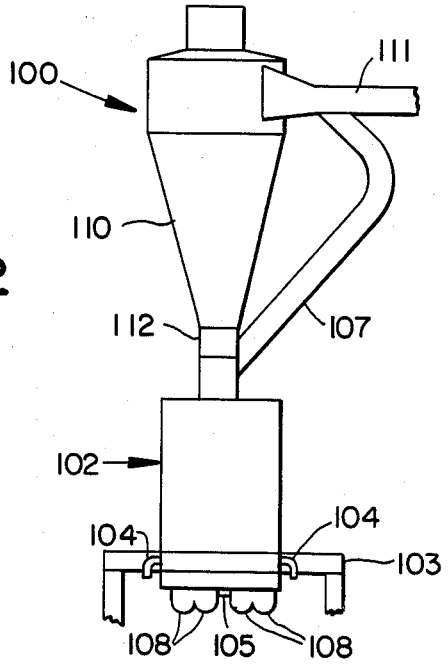
FIG. 2 is an end elevational view of the cooling apparatus of FIG. 1.
Figure 3:
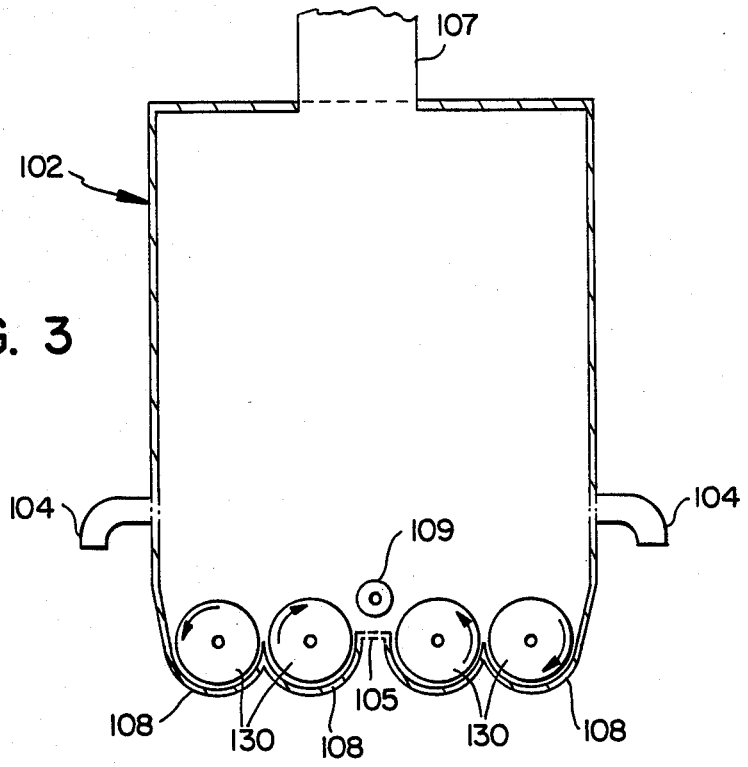
FIG. 3 is a cutaway end view of the cooling apparatus of FIGS. 1 and 2.

In the drawings there is illustrated a preferred type of cooling apparatus 100 of the invention. The apparatus includes a large housing 102 which has an opening at the top through which particulate material can be introduced into the housing.

The housing includes air inlets 104 and 105 in the bottom portion thereof and an air outlet 107 at the top. Thus, ambient or atmospheric air is drawn into the housing through inlets 104 and 105 and exits the housing at the top.

Fan unit 120 is operably connected to the housing by means of pipe 122, cyclone collector 110, and pipe 107. Fan 120 pulls or draws air through pipe 122, collector 110, pipe 107, and housing 102. The fan also draws air through pipe 111 which is connected to collector 110.

Pipe 111 may be connected at its opposite end to a source of particulate material to be dried and cooled. For example, pipe 111 may be connected to a mixer where particulate material are mixed, or it may be connected to a conventional dryer or to a primary collector.

Particulate material which is drawn into collector 110 drops to the bottom where it can exit through airlock 112 directly into housing 102. The collector and airlock are conventional. For example, they are commercially available from Kice and may be provided in any desired size and capacity.

The housing 102 is shown supported on structure 103 of any desired type. The bottom of housing 102 preferably includes a plurality of troughs 108 which extend longitudinally along the length of the housing. Even more preferably the troughs extend slightly beyond one end wall 102A of the housing, as illustrated in FIGS. 1 and 4.

An auger 130 is disposed in each trough 108 and is adapted to be driven in a manner such that each auger conveys dried and cooled particulate material at the bottom of the housing out of one end of the housing.

Figure 4:
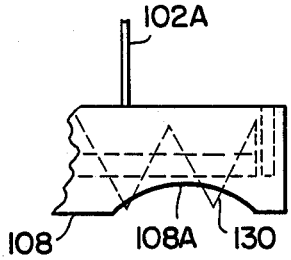
FIG. 4 is a fragmentary side view showing one manner in which particulate material is conveyed out of the cooling apparatus.

This is illustrated in FIG. 4 where there is shown an opening 108A in trough 108 at one end.

Preferably the housing also includes another auger 109 which is located above augers 108 and is centrally disposed in a longitidinal direction. Auger 109 prevents the particulate material from bridging between opposite side walls of the housing. Thus, the particulate material does not hang up in the housing during unloading.

The particulate material which exits the housing is cooler and drier than when it was introduced into the top of the housing 102. The air which is drawn through the housing by fan unit 120 absorbs moisture from the particles and thereby cools them as the particles are dried.

The housing may vary in size. Also, the rate at which air is drawn through the housing may also vary. The temperature and humidity of the air drawn through the cooling unit may also vary. Normally ambient air is sufficient, when drawn through the unit, to reduce the moisture content of the particulate material by several percent. This also cools the particulate material to ambient or room temperature or below.

The cooling/evaporator unit of the invention may be used to remove moisture from any type of particulate material. It is especially useful for cooling particulate material such as hay or roughage materials or other feedstuffs which contain moisture. For example, chopped hay having a length less than about 6 inches and which has been dried in a conventional heated dryer can be cooled very efficiently in this apparatus. As outside air is drawn into the housing 102 the air passes through and around the particles, whereby they are cooled to ambient temperature or below. Then the hay particles can be safely packaged, even in airtight containers, without danage of spoilage.

The cooling unit can also be used to cool other types of particulate materials which contain moisture. As explained above, the apparatus of this invention is especially useful for drying feedstuffs. The size of the particles may vary from finely ground to fibers which are several inches in length.

The extent of cooling and moisture removal which is possible with the cooling unit of the invention may vary. Generally speaking, the cooler the air and the drier it is, the more rapidly the air is able to dry and cool the particles. The rate of air flow through the cooling unit may also be varied, as desired. For example, the air flow rate may be adjusted by means of appropriate dampers in the pipe between the fan unit and the cooling housing. The number and size of the air inlets may also be varied.

As one example, the cooling housing may be ten feet long, ten feet high, and six feet wide. Each auger 130 is 14 inches in diameter, and auger 109 is 6 inches in diameter. Such a housing can hold as much as two tons of chopped alfalfa at one time. The air drawn through the housing may be varied from 0 to 7000 cubic feed per minute. The alfalfa particles can be reduced in moisture content by about 5% in 20 minutes with this apparatus. The temperature of the particles may be reduced to 15° F. below ambient air temperature due to evaporation of moisture.

The particles may be left in the housing as long as desired to reduce the temperature of the particles. For example, if the air being drawn through the housing is of high humidity, a longer time may be required to cool the particles because less evaporation of moisture occurs. The augers 130 need not be continuously operated. The particles may be contained in the housing so long as desired in order to reduce the temperature of the particles. Then the augers may be activated to convey the dried and cooled particles out of the housing. The speed of the auger conveyors may vary.

Other types of conveyors may be used in place of augers. However, augers are very efficient and reliable. The number and size of the augers may also be varied.

Other variants are possible without departing from the scope of this invention. For example, the particulate material may be introduced into housing 102 by means of a conveyor instead of through a collector and airlock system. Also, air which is drawn into the housing could be preconditioned, if desired, to remove humidity or to cool it before it passes through housing 102.

What is claimed is:

1. Cooler apparatus for cooling particulate material containing moisture, said apparatus comprising:

(a) a housing having top and bottom portions; said housing including an opening in said top portion for introducing said particulate material into said housing; said housing further including at least one air inlet in said bottom portion and an air outlet in said top portion;

(b) air movement means for drawing air into said housing through said air inlet and then out of said housing through said outlet in a manner such that said air is able to absorb moisture from said particulate material;

(c) conveyor means in said bottom portion of said housing, said conveyor means comprising a plurality of conveyor augers being adapted to convey said particulate material out of said housing; wherein said bottom portion of said housing includes troughs; wherein each said auger is disposed in one of said troughs; wherein said apparatus further includes a central auger above said conveyor augers; wherein said central auger extends from one end of said housing to the opposite end and is adapted to prevent bridging of said particulate material between the sides of said housing;

wherein said particulate material is cooled to said housing when said air absorbs moisture from said particulate material.

2. Cooler apparatus in accordance with claim 1, wherein said air movement means comprises a fan.

3. Cooler apparatus in accordance with claim 1, wherein there are a plurality of said air inlets.

4. Cooler apparatus for cooling particulate material containing moisture, said apparatus comprising:

(a) a housing having top and bottom portions, opposing side walls, and first and second ends; said housing including an opening in said top portion for introducing said particulate material into said housing; said housing further including a plurality of air inlets in said bottom portion and an air outlet in said top portion;

(b) air movement means for drawing air into said housing through said air inlet and then out of said housing through said outlet in a manner such that said air is able to absorb moisture from said particulate material;

(c) conveyor means in said bottom portion of said housing, wherein said conveyor means comprises a plurality of conveyor augers extending from said first end of said housing to said second end thereof; wherein said bottom portion of said housing includes a plurality of troughs extending longitudinally from said first end to said second end thereof, wherein each said conveyor auger is disposed in one of said troughs; wherein said apparatus further includes a central auger above said conveyor augers; wherein said central auger extends from said first end to said second end of said housing and is adapted to prevent bridging of said particulate material between said opposite side walls; wherein said conveyor augers are adapted to convey said particulate material out of said housing;

wherein said particulate material is cooled in said housing when said air absorbs moisture from said particulate material.

5. Cooler apparatus in accordance with claim 4, wherein said air movement means comprises a fan.

6. Cooler apparatus in accordance with claim 5, wherein said fan is capable of drawing air at the rate of about 7000 feet per minute.

* * * * *